US010919550B2

(12) United States Patent
Haedicke et al.

(10) Patent No.: US 10,919,550 B2
(45) Date of Patent: Feb. 16, 2021

(54) METHOD AND POSITIONING DEVICE FOR DETERMINING THE POSITION OF A TRACK-GUIDED VEHICLE, IN PARTICULAR A RAIL VEHICLE

(71) Applicant: SIEMENS MOBILITY GMBH, Munich (DE)

(72) Inventors: Florian Haedicke, Braunschweig (DE); Andreas Steingroever, Braunschweig (DE); Steffen Ueckert, Lehrte (DE)

(73) Assignee: Siemens Mobility GmbH, Munich (DE)

( * ) Notice: Subject to any disclaimer, the term of this patent is extended or adjusted under 35 U.S.C. 154(b) by 379 days.

(21) Appl. No.: 15/554,138

(22) PCT Filed: Feb. 4, 2016

(86) PCT No.: PCT/EP2016/052379
§ 371 (c)(1),
(2) Date: Aug. 28, 2017

(87) PCT Pub. No.: WO2016/134940
PCT Pub. Date: Sep. 1, 2016

(65) Prior Publication Data

US 2018/0037242 A1 Feb. 8, 2018

(30) Foreign Application Priority Data

Feb. 26, 2015 (DE) ..... 10 2015 203 476.3

(51) Int. Cl.
*B61L 25/02* (2006.01)
*B61L 3/00* (2006.01)

(52) U.S. Cl.
CPC ..... *B61L 25/025* (2013.01); *B61L 3/002* (2013.01); *B61L 25/026* (2013.01)

(58) Field of Classification Search
CPC ..... B61L 25/025; B61L 25/026; B61L 3/002
(Continued)

(56) References Cited

U.S. PATENT DOCUMENTS 3,888,437 A * 6/1975 Birkin ..... B61L 3/121 246/63 A
5,036,478 A * 7/1991 MacDougall ..... B61L 1/16 702/158

(Continued)

FOREIGN PATENT DOCUMENTS

CN 103192853 A 7/2013
CN 103770808 A 5/2014

(Continued)

OTHER PUBLICATIONS

Wolfgang Fenner, et al; Bahnsicherungstechnik: Steuem, Sicher und Überwachen von Fahrwegen und Fahrgeschwindigkeiten im Schienenverkehr; 2003; pp. 424-425; Publicis Coprorate Publishing, ISBN: 3-89578-177-0—English abstract.

(Continued)

*Primary Examiner* — Zachary L Kuhfuss
(74) *Attorney, Agent, or Firm* — Laurence Greenberg; Werner Stemer; Ralph Locher

(57) ABSTRACT

A method for determining the position of a track-guided vehicle, in particular a rail vehicle, includes readjusting a distance measuring device on the vehicle for obtaining position-determining distance measurement values based on position marker information available at position markers on the track, wherein the position marker information is captured by a position marker information recorder connected to the distance measuring device. In order to be able to carry out an exact determination of the position of a track-guided vehicle in a comparatively simple way, the position marker information of the same position marker is detected again by a further position marker information recorder being offset (Continued)

relative to the first position marker information recorder in the longitudinal direction of the vehicle and a generation of further position-determining distance measurement values is initiated. A positioning device for determining the position of a track-guided vehicle is also provided.

11 Claims, 1 Drawing Sheet

(58) Field of Classification Search
USPC ..... 701/19; 246/122 R
See application file for complete search history.

(56) References Cited

U.S. PATENT DOCUMENTS 5,548,516 A * 8/1996 Gudat ..... G01S 19/11 701/23
5,803,411 A * 9/1998 Ackerman ..... B61L 3/00 246/169 R
5,893,043 A * 4/1999 Moehlenbrink ..... B61L 3/004 246/182 C
6,666,411 B1 * 12/2003 Hart ..... B61L 27/0038 246/1 C
6,804,621 B1 * 10/2004 Pedanckar ..... E01B 37/00 702/85
7,099,754 B2 * 8/2006 Sugita ..... B61L 23/14 246/14
7,130,753 B2 * 10/2006 Pedanekar ..... B61L 25/026 702/94
7,201,350 B2 * 4/2007 Sugita ..... B61L 3/125 246/122 R
7,269,487 B2 * 9/2007 Watanabe ..... B61L 1/18 246/122 R
7,769,538 B2 * 8/2010 Rousseau ..... B61L 25/021 701/519
8,149,160 B2 * 4/2012 Bray ..... B61L 25/021 342/104
8,214,091 B2 * 7/2012 Kernwein ..... B61L 25/025 701/19
8,467,920 B2 * 6/2013 Asuka ..... B61L 23/14 246/167 D
8,469,318 B2 * 6/2013 Kaluscha ..... B61L 1/14 246/122 R
8,985,524 B2 * 3/2015 Takahashi ..... B61L 27/0038 246/167 R
9,162,689 B2 * 10/2015 Itagaki ..... B61L 1/10
9,174,657 B2 * 11/2015 Morris ..... B61L 27/0077
9,216,749 B2 * 12/2015 Itagaki ..... B61L 1/10
9,327,743 B2 * 5/2016 Green ..... B61L 15/0063
9,610,961 B2 * 4/2017 Breuing ..... G01S 17/58
9,846,025 B2 * 12/2017 Kirchner ..... G01B 11/00
2004/0138788 A1 * 7/2004 Herzog ..... B61L 25/025 701/19
2004/0236482 A1 11/2004 Kane et al.
2005/0133673 A1 * 6/2005 Sugita ..... B61L 27/0038 246/167 R
2007/0203640 A1 8/2007 Rousseau
2014/0326835 A1 * 11/2014 Schwellnus ..... B61L 25/02 246/122 R
2015/0251675 A1 * 9/2015 Ohmstede ..... B61L 3/121 246/122 R
2018/0037242 A1 * 2/2018 Haedicke ..... B61L 25/026

FOREIGN PATENT DOCUMENTS

DE 3624045 A1 2/1988
DE 19729981 A1 1/1999
DE 102005046456 A1 3/2007
DE 102006033210 A1 1/2008

OTHER PUBLICATIONS

Wolfgang Fenner, et al; Bahnsicherungstechnik: Steuem, Sicher und Überwachen von Fahrwegen und Fahrgeschwindigkeiten im Schienenverkehr; 2003; pp. 424-425; Publicis Coprorate Publishing, ISBN: 3-89578-177-0—English summary following.

* cited by examiner

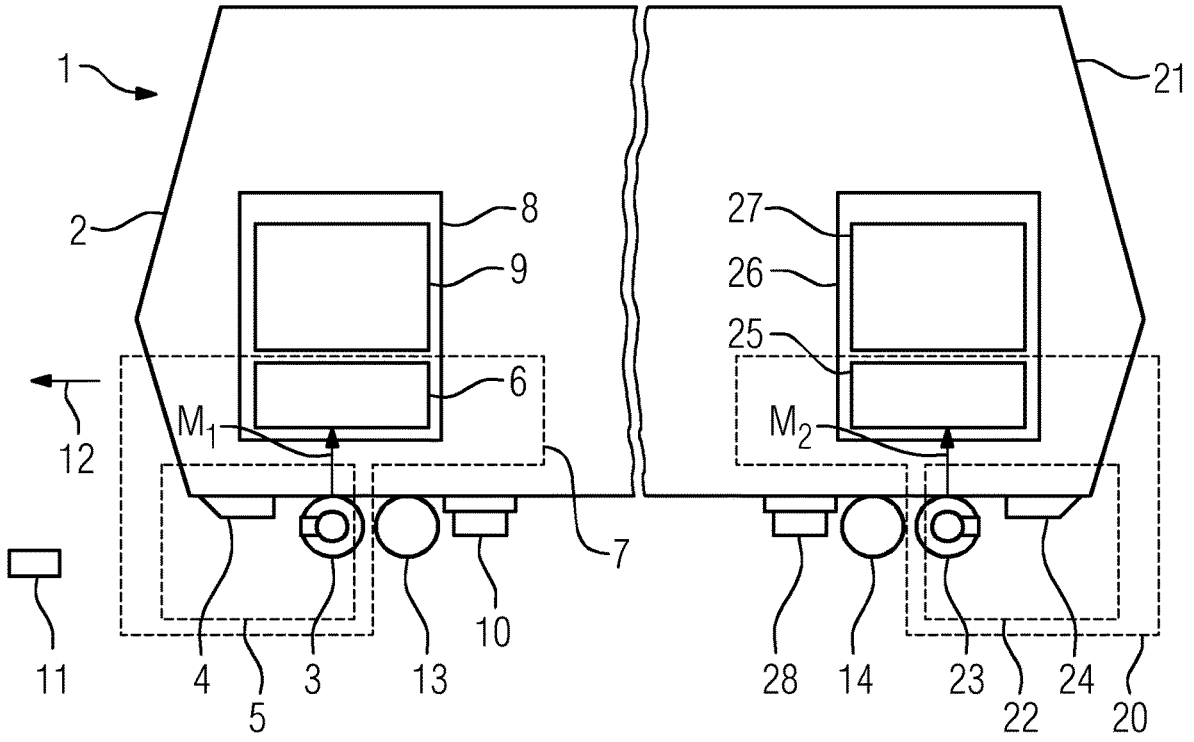
1
2
8
9
6
M1
12
7
11
4
5
3
13
10
21
27
26
25
M2
28
14
23
22
24
20

METHOD AND POSITIONING DEVICE FOR DETERMINING THE POSITION OF A TRACK-GUIDED VEHICLE, IN PARTICULAR A RAIL VEHICLE

BACKGROUND OF THE INVENTION

Field of the Invention

The invention relates to a method for determining the position of a track-guided vehicle, in particular a rail vehicle, comprising a distance measuring device which is provided on the vehicle for the purpose of obtaining position-determining distance measurement values and is readjusted in each case on the basis of position marker information that is available at position markers on the track, said position marker information being captured by means of a position marker information recorder which is connected to the distance measuring device.

A method of this type can be found in the book "Bahnsicherungstechnik" by S. Fenner, B. Naumann, J. Trinckauf, 2003, pages 424 and 425. According to this known method, for the purpose of obtaining a position-finding accuracy that is required for modern train control systems, the measurement of the distance that has been covered is triggered at position markers in each case. It is obviously assumed in this case that the distance measurement is effected either in a conventional manner by detecting the wheel rotations with the aid of a wheel or rotation pulse generator or by means of radar sensors on the locomotive.

With regard to the distance measurement, in particular by means of odometer pulse generators, it is also known that inaccuracies occur for technical reasons and accumulate with the distance covered. Therefore tolerance limit values are defined for the distance measurement values, and if these are exceeded the track-guided vehicle is no longer allowed to use the calculated position; it is then considered to be "delocalized". The tolerance limit values for the distance measurement values from odometer pulse generators are reached if, owing to the measurement error per unit of distance of the respective odometer pulse generator, a corresponding distance has been covered. Delocalization also occurs if sensors that are involved in the distance measurement fail. If the track-guided vehicle is delocalized, this means that a vehicle device belonging to the track-guided vehicle and comprising e.g. vehicle-related components, such as e.g. components for automatic vehicle operation, for train control and for vehicle position-finding, can no longer guarantee its monitoring function and assumes a restrictive state. In this state, the possibilities for monitoring train movement are significantly restricted. In the case of driverless railroad operation in particular, the operational consequences are considerable, since it may be necessary for service personnel to gain access to the vehicle in order to reestablish the operational readiness of the train control system or to manually control the further train movement.

In order to allow localization, position markers have often been provided at relatively short intervals, for example a transposition point distance of 100 m intervals and up to 12.8 km loop length in the case of the continuous automatic train control CATC 80, and a 25.6 cm transposition point distance and up to 200 m loop length in the case of the suspended monorail.

Satellite navigation data has also been used as further absolute position information, though this can only be used to determine a position outside a tunnel.

SUMMARY OF THE INVENTION

The object of the invention is to develop a method of the type cited in the introduction, such that the position of a track-guided vehicle can be accurately determined in a comparatively simple manner.

In order to achieve this object, in the context of the method of the type cited in the introduction, a further position marker information recorder, which is offset relative to the first position marker information recorder in the longitudinal direction of the vehicle, inventively captures the position marker information of the same position marker again in each case, and initiates the generation of further position-determining distance measurement values.

Although European patent application EP 0 761 522 A 1 discloses the provision of an object sensor system and a rotational angle measuring system in addition to a distance measuring system for the purpose of determining the position of a track-guided vehicle, the position results obtained by these three measuring systems are nonetheless subjected to an auctioneering decision making process in an evaluation unit, in order to identify which predetermined position interval contains two of the three position results.

An essential advantage of the method according to the invention is that further position-determining distance measurement values can be generated by means of the further position marker information recorder, with the possibility of using the more accurate distance measurement values in each case for the purpose of determining the position of the track-guided vehicle, resulting in greater accuracy when determining the position.

The method according to the invention advantageously only requires a single distance measuring device if the further position marker information recorder activates the distance measuring device, with readjustment in each case, to generate the further position-determining distance measurement values.

It can however also be advantageous for the further position marker information recorder to activate a connected further distance measuring device on the vehicle, with readjustment in each case, to generate the further position-determining distance measurement values. The first and the further position-determining distance measurement values are then concurrently available in each case.

In an advantageous embodiment of the method according to the invention, the first position-determining distance measurement values are monitored for compliance with predetermined tolerance limits and if position-determining distance measurement values are at a tolerance limit, the further position-determining distance measurement values are used for the purpose of determining the position of the vehicle if the tolerance of the further position-determining distance measurement values is less than the tolerance limit of the first position-determining distance measurement values. The method cited above with two distance measuring devices is particularly suitable for this purpose.

Using the inventive method, the offset arrangement and attachment of the two position marker information recorders on the track-guided vehicle can be effected in various ways in the longitudinal direction of the vehicle.

In order optimally to exploit the advantages of the inventive method, it is however considered advantageous to install the first position marker information recorder at the front of the track-guided vehicle and the other position marker information recorder at the tail of the track-guided vehicle. In this variant of the inventive method, until the further position marker information recorder intervenes, the first position-determining distance measurement values are used for the purpose of determining the position of the vehicle, and thereafter the further position-determining distance measurement values are used. The further position marker information recorder at the tail of the track-guided vehicle only reaches the position marker after the travel time required for a travel distance corresponding to the length of the vehicle and only then activates the distance measuring device (or optionally the further distance measuring device), with readjustment, to generate the further position-determining distance measurement values; in this way, the position determination is particularly accurate.

In the context of the inventive method, the first and optionally also the further distance measuring device can be variously designed and variously disposed in relation to the vehicle device of the track-guided vehicle. It can therefore be advantageous to use an evaluation device which is integrated in the vehicle device of the track-guided vehicle and is connected to the distance measuring device. The same applies correspondingly to the inventive method with two distance measuring devices, each having an evaluation device.

In the context of the inventive method, it can also be advantageous to use an evaluation device which is available independently in the track-guided vehicle and is connected to the distance measuring device. Correspondingly, evaluation devices for two distance measuring devices can also be used which are arranged independently.

In the context of the inventive method, it is advantageously possible to use distance measuring devices with odometer pulse generators, radar range-finding devices, range-finding equipment with acceleration sensors, range-finding arrangements with eddy current samplers or range-finding units with optical rail samplers.

The position marker information can be generated in different ways in the context of the inventive method. It is considered advantageous to generate the position marker information by means of fixed position markers that are present on the track. This embodiment variant of the inventive method has the advantage that fixed position markers on the track can be used.

However, it is also advantageous if applicable to use satellite information data as position marker information.

The invention further relates to a positioning device for determining the position of a track-guided vehicle, in particular a rail vehicle, comprising a distance measuring device which is provided on the vehicle for the purpose of obtaining position-determining distance measurement values and is readjusted in each case on the basis of position marker information that is present on the track in each case, said distance measuring device being connected to a position marker information recorder as per the prior art cited in the introduction, and has as its object to further develop said positioning device such that it is able accurately to calculate the position of a track-based vehicle with comparatively little effort.

In order to achieve this object, with regard to the positioning device, a further position marker information recorder is provided on the vehicle and is offset in the longitudinal direction of the vehicle, wherein said further position marker information recorder is able to capture the position marker information of the same position marker again in each case, and to initiate the generation of the further position-determining distance measurement values.

Essentially the same advantages are achieved by virtue of the inventive positioning device as are stated in the introduction in respect of the inventive method.

In the case of the inventive positioning device, the further position marker information recorder is advantageously able to activate the distance measuring device, with readjustment in each case, to generate the further position-determining distance measurement values. This embodiment variant of the inventive positioning device therefore requires only one distance measuring device.

In a further advantageous embodiment, the further position marker information recorder is connected to a further distance measuring device on the vehicle, and the further position marker information recorder is able to activate the further distance measuring device, with readjustment in each case, to generate the further position-determining distance measurement values. In the case of such a positioning device, if an evaluation arrangement is connected to both distance measuring devices and said evaluation arrangement is able to monitor the first position-determining distance measurement values for compliance with predetermined tolerance limits and, where position-determining distance measurement values are at a tolerance limit, to use the further position-determining distance measurement values for the purpose of determining the position of the vehicle if the tolerance of the further position-determining distance measurement values is less than the tolerance limit of the first position-determining distance measurement values, the determination of the position can then be performed in a particularly accurate manner in each case.

The position marker information recorders can be arranged variously in an offset manner on the track-guided vehicle.

It is considered particularly advantageous in respect of the inventive positioning device for the first position marker information recorder to be arranged at the front of the vehicle and the further position marker information recorder at the tail of the vehicle.

If this embodiment variant is equipped with a single distance measuring device, the distance measuring device is advantageously able, until activated by the further position marker information recorder, to use the first position-determining distance measurement values for the purpose of determining the position of the vehicle and thereafter to use the further position-determining distance measurement values. This has the advantage that the further position marker information recorder at the tail of the track-guided vehicle only reaches the position marker after the travel time required for a travel distance corresponding to the length of the vehicle and only then performs a readjustment of the distance measurement. If distance measuring devices having a odometer pulse generator each are used, for example, then the first odometer pulse generator initially measures accurately, followed by the further odometer pulse generator, until the first position marker information recorder goes past the next position marker.

In the case of a positioning device with two distance measuring devices, provision can also be made for a shared evaluation arrangement which is able, for the purpose of determining the position of the vehicle, initially to use the first position-determining distance measurement values of the first distance measuring device and then, after activation of the further distance measuring device by the further position marker information recorder, to use the further position-determining distance measurement values.

The evaluation device of a positioning device with only one distance measuring device can be integrated in the vehicle device of the track-based vehicle. The same applies in respect of an evaluation arrangement in the case of a positioning device with two distance measuring devices.

However, the evaluation device and/or the evaluation arrangement can also be arranged independently in the vehicle.

In a further advantageous embodiment, the distance measuring devices are equipped with odometer pulse generators, radar range-finding devices, range-finding equipment with acceleration sensors, range-finding arrangements with eddy current samplers or range-finding units with optical rail samplers.

The fixed position markers may be present on the track. However, it can also be advantageous if the position marker information consists of satellite navigation panels.

BRIEF DESCRIPTION OF THE SINGLE VIEW OF THE DRAWING

The figure of the drawing is a fragmentary, diagrammatic, side-elevational view of a track-guided vehicle and a position marker.

DESCRIPTION OF THE INVENTION

In order to explain the invention further, an exemplary embodiment of a positioning device according to the invention is illustrated in the figure, wherein said positioning device comprises respectively corresponding distance measuring devices and position marker information recorders at the front and tail of the track-guided vehicle.

The figure shows a track-guided vehicle 1 which is equipped at the front 2 with a distance measuring unit 3 in the form of a merely schematically illustrated odometer pulse generator. In addition, a further distance measuring unit 4, here in the form of a radar sensor, is arranged adjacent to the first distance measuring unit 3. Both distance measuring units 3 and 4 together form a distance measuring device 5 and are connected (in a manner that is not illustrated) to an evaluation device 6 which together with the distance measuring device 5 forms a distance measuring arrangement 7. The evaluation device 6 is part of a vehicle device 8, which also has an arrangement 9 for performing further vehicle functions such as automatic train operation and train control, for example.

The track-guided vehicle 1 is additionally equipped with a position marker information recorder in the form of a position marker reader 10, which then interacts with a merely schematically illustrated position marker 11 and provides position information to the evaluation device 6 (in a manner that is not illustrated) when the track-guided vehicle 1 with its position marker reader 10 goes past the position marker 11 during a movement in the direction of the arrow 12. Also schematically illustrated in FIG. 1 are wheels 13 and 14 on axles (not shown) of the track-guided vehicle 1.

When the track-guided vehicle 1 during its travel arrives in the region of the position marker 11, position marker information is transmitted to the evaluation device 6. In this case, both the odometer pulse generator of the first distance measuring unit 3 and the radar sensor of the further distance measuring unit 4 are readjusted (in a manner that is not illustrated); they resume their distance measurement while generating distance measurement values. The distance measuring unit 3 in the form of an odometer pulse generator is characterized by measured values of great accuracy at the beginning of the distance covered from the position marker 10, and therefore these distance measurement values as position-determining distance measurement values M1 are initially used for the purpose of determining the position. The radar sensor of the further distance measuring unit 4 is initially relatively inaccurate, particularly at low speeds. However, this changes at higher speeds.

A further distance measuring arrangement 20 is provided at the tail 21 of the vehicle 1 shown. This distance measuring arrangement 20 is constructed in accordance with the first distance measuring arrangement 7, and therefore contains a further distance measuring device 22 with an additional distance measuring unit 23 in the form of an odometer pulse generator and a further additional distance measuring unit 24 in the form of a further radar sensor. Moreover, part of the further distance measuring arrangement 20 is a further evaluation device 25 corresponding to the first evaluation device 6. The evaluation device 25 is part of a further vehicle device 26, which also has an arrangement 27 for performing further vehicle functions such as automatic train operation and train control, for example.

When the track-guided vehicle 1 during travel in the direction of the arrow 12 arrives with its position marker reader 10 in the region of the position marker 11, the odometer pulse generator of the first distance measuring unit 3 is readjusted, and the first distance measurement values supplied by this distance measuring unit are used as position-determining distance measurement values M1 by the first evaluation device 6 for the purpose of determining the position. This takes place until the track-guided vehicle 1 with its further position marker reader 28 arrives in the region of the position marker 11. At this point in time, the odometer pulse generator of the first additional distance measuring unit 23 is readjusted by the position marker information of the position marker 11 received by the further evaluation device 25, and its distance measurement values are transmitted as further position-determining distance measurement values M2 to the further evaluation device 25. The further evaluation device 25 then assumes responsibility for determining the position of the track-guided vehicle 1. This continues until the track-guided vehicle 1 with its position marker reader 10 passes a further position marker (not shown in the FIG. 2), whereupon the first distance measuring unit 3 is readjusted again and its distance measurement values as the first position-determining distance measurement values are used again by the evaluation device 6 for the purpose of determining the position. This means that, assuming an interval of e.g. 500 meters between the position marker 11 and a further position marker which is positioned next in the direction of the arrow 12 and a train length of e.g. 300 meters, 300 meters of the distance covered by the track-guided vehicle 1 is monitored by the first distance measuring unit 3 for the purpose of determining the position of the track-guided vehicle 1, and the remaining 200 meters is monitored by the first additional distance measuring unit 23 in the further distance measuring device 22 of the distance measuring arrangement 20 at the tail 21 of the vehicle 1. If in a further assumed scenario the interval between the position markers is again 500 meters but the train has a length of only 100 meters, then the distance measurement values of the first distance measuring unit 3 are used over 100 meters and the further distance measurement values of the first additional distance measuring unit 23 are used for the remaining 400 meters. The track-guided vehicle 1 therefore measures predominantly using the first additional distance measuring unit 23 at the tail 21 of the vehicle 1, and only uses the first distance measuring unit 3 at the front 2 of the track-guided vehicle for a length of vehicle after the vehicle passes over the respective position marker. This results in a significant improvement in accuracy when determining the position of the vehicle 1.

The invention claimed is:

1. A method for determining a position of a rail vehicle, the method comprising the following steps:

using a distance measuring device provided on the vehicle for obtaining first position-determining distance measurement values;

readjusting the distance measuring device based on position marker information available at a position marker on a track;

using a first position marker information recorder connected to the distance measuring device for capturing the position marker information;

using a second position marker information recorder, being offset relative to the first position marker information recorder in a longitudinal direction of the vehicle, for capturing the position marker information of the same position marker and initiating a generation of second position-determining distance measurement values;

connecting a first evaluation device and a further evaluation device to the distance measuring device;

installing the first position marker information recorder at a front of the vehicle and installing the second position marker information recorder at a rear of the vehicle;

when a given position marker is passed by the first position marker information recorder, adjusting the distance measuring device using position marker information captured by the first position marker information recorder, and then providing position-determining distance measurement values of the distance measuring device, which has been adjusted to the first evaluation device and, with the first evaluation device, determining the position of the vehicle from the position-determining distance measurement values of the distance measuring device, which has been adjusted, until the given position marker is passed by the second position marker information recorder; and when the given position marker is passed by the second position marker information recorder, readjusting the distance measuring device or a further distance measuring device connected to the second position marker information recorder, by position marker information from a respective position marker captured by the second position marker information recorder, and then providing position-determining distance measurement values of the distance measuring device, which has been readjusted, to the further evaluation device and, with the further evaluation device, determining the position of the vehicle from the position-determining distance measurement values of the distance measuring device, which has been readjusted.

2. The method according to claim 1, which further comprises using the second position marker information recorder to activate the distance measuring device, with readjustment, for generating the second position-determining distance measurement values.

3. The method according to claim 1, which further comprises using the second position marker information recorder to activate a connected further distance measuring device on the vehicle, with readjustment, for generating the second position-determining distance measurement values.

4. The method according to claim 1, which further comprises monitoring the first position-determining distance measurement values for compliance with predetermined tolerance limits, so that if the position-determining distance measurement values are at a tolerance limit, the second position-determining distance measurement values are used for determining the position of the vehicle if a tolerance of the second position-determining distance measurement values is less than a tolerance limit of the first position-determining distance measurement values.

5. The method according to claim 1, which further comprises using the first position-determining distance measurement values for determining the position of the vehicle until activation by the second position marker information recorder, and thereafter using the second position-determining distance measurement values.

6. The method according to claim 1, which further comprises providing the distance measuring devices with odometer pulse generators, radar range-finding devices, range-finding equipment with acceleration sensors, range-finding configurations with eddy current samplers, or range-finding units with optical rail samplers.

7. A positioning device for determining a position of a rail vehicle, the positioning device comprising:

a distance measuring device provided on the vehicle for obtaining first position-determining distance measurement values, said distance measuring device being readjusted based on position marker information present at a position marker on a track;

a first position marker information recorder connected to said distance measuring device;

a second position marker information recorder provided on the vehicle and being offset relative to said first position marker information recorder in a longitudinal direction of the vehicle;

a first evaluation device and a further evaluation device connected to said distance measuring device;

said second position marker information recorder being configured to capture the position marker information of the same position marker and to initiate a generation of second position-determining distance measurement values;

the first position marker information recorder is installed at a front of the vehicle and the second position marker information recorder is installed at a rear of the vehicle;

wherein the positioning device is configured such that when a given position marker is passed by the first position marker information recorder, the distance measuring device is adjusted using position marker information captured by the first position marker information recorder, and until the given position marker is passed by the second position marker information recorder, position-determining distance measurement values of the distance measuring device, which has been adjusted, are provided to the first evaluation device, and the first evaluation device is configured to determine the position of the vehicle from the position-determining distance measurement values of the distance measuring device, which has been adjusted; and wherein the positioning device is configured such that when the given position marker is passed by the second position marker information recorder, the distance measuring device or a further distance measuring device connected to the second position marker information recorder is readjusted by position marker information from a respective position marker captured by the second position marker information recorder, and after the readjustment, position-determining distance measurement values of the distance measuring device, which has been readjusted, are provided to the further evaluation device, and the further evaluation device is configured to determine the position of the vehicle from the position-determining distance measurement values of the distance measuring device, which has been readjusted.

8. The positioning device according to claim 7, wherein said second position marker information recorder is configured to activate said distance measuring device, with readjustment, for generating said second position-determining distance measurement values.

9. The positioning device according to claim 7, which further comprises:

a further distance measuring device disposed on the vehicle and connected to said second position marker information recorder;

said second position marker information recorder being configured to activate said second distance measuring device, with readjustment, for generating said second position-determining distance measurement values.

10. The positioning device according to claim 9, wherein the first evaluation device is connected to said distance measuring device for monitoring said first position-determining distance measurement values for compliance with predetermined tolerance limits, so that if position-determining distance measurement values are at a tolerance limit, said further position-determining distance measurement values are used for determining the position of the vehicle if a tolerance of said second position-determining distance measurement values is less than a tolerance limit of the first position-determining distance measurement values.

11. The positioning device according to claim 7, wherein said distance measuring device is configured to use said first position-determining distance measurement values for determining the position of the vehicle until activated by said second position marker information recorder and is configured to thereafter use said second position-determining distance measurement values.

* * * * *